US008012042B2

(12) United States Patent
Abe

(10) Patent No.: US 8,012,042 B2
(45) Date of Patent: Sep. 6, 2011

(54) GOLF CLUB HEAD

(75) Inventor: Hiroshi Abe, Kobe (JP)

(73) Assignee: SRI Sports Limited, Kobe (JP)

( * ) Notice: Subject to any disclaimer, the term of this patent is extended or adjusted under 35 U.S.C. 154(b) by 55 days.

(21) Appl. No.: 12/336,276

(22) Filed: Dec. 16, 2008

(65) Prior Publication Data

US 2009/0258726 A1 Oct. 15, 2009

(30) Foreign Application Priority Data

Apr. 14, 2008 (JP) ..... 2008-104505

(51) Int. Cl.
*A63B 53/04* (2006.01)

(52) U.S. Cl. ..... 473/345

(58) Field of Classification Search ..... 473/324–350
See application file for complete search history.

(56) References Cited

U.S. PATENT DOCUMENTS

| | | | | |
|---|---|---|---|---|
| 6,296,576 | B1 * | 10/2001 | Capelli | 473/326 |
| 6,306,048 | B1 * | 10/2001 | McCabe et al. | 473/333 |
| 6,991,560 | B2 * | 1/2006 | Tseng | 473/332 |
| 2007/0049400 | A1 * | 3/2007 | Imamoto et al. | 473/329 |

FOREIGN PATENT DOCUMENTS

| | | | |
|---|---|---|---|
| JP | 06319836 | A * | 11/1994 |
| JP | 2000-325507 | A | 11/2000 |
| JP | 2004-121744 | A | 4/2004 |

* cited by examiner

*Primary Examiner* — Alvin Hunter
(74) *Attorney, Agent, or Firm* — Birch, Stewart, Kolasch & Birch, LLP

(57) ABSTRACT

A head (2) includes an outer shell portion (4) forming an external surface of the head and a hollow portion (16) of the head, an inside extended portion (18) extended from the outer shell portion (4) to an inner part of the head, a housing portion (s1) formed by the outer shell portion (4) and the inside extended portion (18), and an adjusting material (w1) disposed in the housing portion (s1). The outer shell portion (4) is formed by bonding a plurality of outer shell forming members (26) and (28) formed integrally respectively. The outer shell forming member (26) has the inside extended portion (18), and the outer shell forming member (28) has the outer shell portion (4) to be a part of the housing portion (s1). One of the outer shell forming members may have the whole housing portion (s1) and may be formed by casting a metallic material.

10 Claims, 9 Drawing Sheets

GOLF CLUB HEAD

This application claims priority on Patent Application No. 2008-104505 filed in JAPAN on Apr. 14, 2008, the entire contents of which are hereby incorporated by reference.

BACKGROUND OF THE INVENTION

1. Field of the Invention

The present invention relates to a golf club head.

2. Description of the Related Art

As documents disclosing a technique for providing an adjusting material in a hollow portion of a golf club head, there have been known Japanese Laid-Open Patent Publication No. 2004-121744 and Japanese Laid-Open Patent Publication No. 2000-325507. In the Japanese Laid-Open Patent Publication No. 2004-121744, a housing portion for an adjusting material is provided in a hollow portion. In the Japanese Laid-Open Patent Publication No. 2000-325507, a partition wall is provided in a hollow portion to adjust an arrangement of an adjusting material.

SUMMARY OF THE INVENTION

In order to manufacture a golf club head having a hollow portion, it is necessary to bond at least two members (dividing members) formed integrally respectively. In the case in which the housing portion is formed as described in the invention of the Japanese Laid-Open Patent Publication No. 2004-121744, it is necessary to manufacture an intermediate member by bonding a member for forming the housing portion to an internal surface side of a dividing member which has not been bonded and to then bond the intermediate member to the other dividing member. In this case, a large number of bonding steps are provided and the number of the members is increased. For this reason, a productivity is poor and a cost is increased. In the invention of the Japanese Laid-Open Patent Publication No. 2000-325507, moreover, a weight of the partition wall itself is great. For this reason, a degree of freedom of a design for a head tends to be restricted by the partition wall.

It is an object of the present invention to provide a hollow golf club head which includes a housing portion for an adjusting material and can achieve an enhancement in a productivity and a reduction in a cost.

A golf club head according to the present invention includes an outer shell portion forming an external surface of the head and a hollow portion of the head, an inside extended portion extended from the outer shell portion to an inner part of the head, a housing portion formed by the outer shell portion and the inside extended portion, and an adjusting material disposed in the housing portion. The outer shell portion is formed by bonding a plurality of outer shell forming members formed integrally respectively. One of the outer shell forming members has the inside extended portion and the other outer shell forming member has the outer shell portion to be a part of the housing portion.

Another golf club head according to the present invention includes an outer shell portion forming an external surface of the head and a hollow portion of the head, an inside extended portion extended from the outer shell portion to an inner part of the head, a housing portion formed by the outer shell portion and the inside extended portion, and an adjusting material disposed in the housing portion. The outer shell portion is formed by bonding a plurality of outer shell forming members formed integrally respectively. One of the outer shell forming members has the housing portion and is formed by casting a metallic material.

It is preferable that a through hole for causing the external surface of the head to communicate with the housing portion should be provided. It is preferable that the adjusting material should be a thermoplastic resin.

In the golf club head having the housing portion for an adjusting material in the hollow portion, it is possible to simplify a manufacturing process.

DESCRIPTION OF THE PREFERRED EMBODIMENTS

Figure 1:
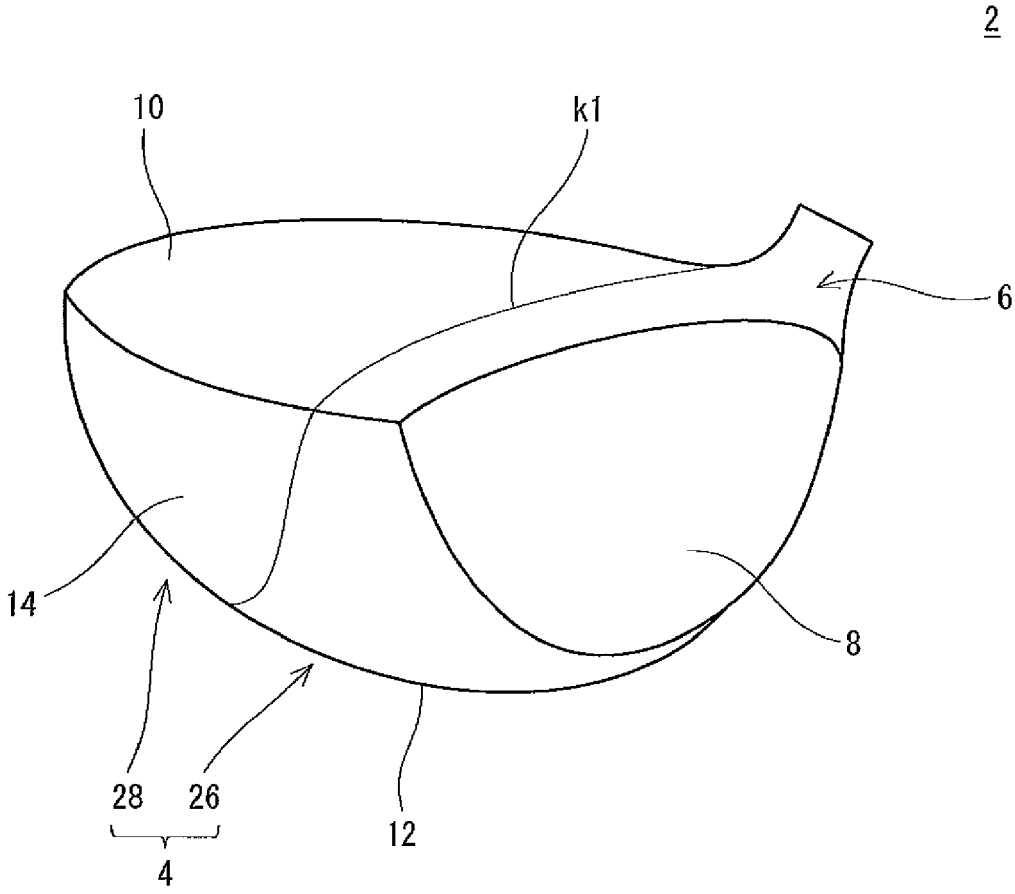
FIG. 1 is a perspective view showing a golf club head according to a first embodiment.

The present invention will be described below in detail based on preferred embodiments with reference to the drawings.

As shown in FIGS. 1 to 4, a head 2 has an outer shell portion 4 and a hosel portion 6. The outer shell portion 4 constitutes an external surface of the head 2. An external surface of the outer shell portion 4 serves as the external surface of the head 2. The outer shell portion 4 has a face portion 8, a crown portion 10, a sole portion 12 and a side portion 14. A hollow portion 16 is present in the outer shell portion 4. More specifically, the hollow portion 16 is formed by the outer shell portion 4. An internal surface of the outer shell portion 4 forms the hollow portion 16. A shaft hole 17 is provided on the hosel portion 6.

Figure 5:
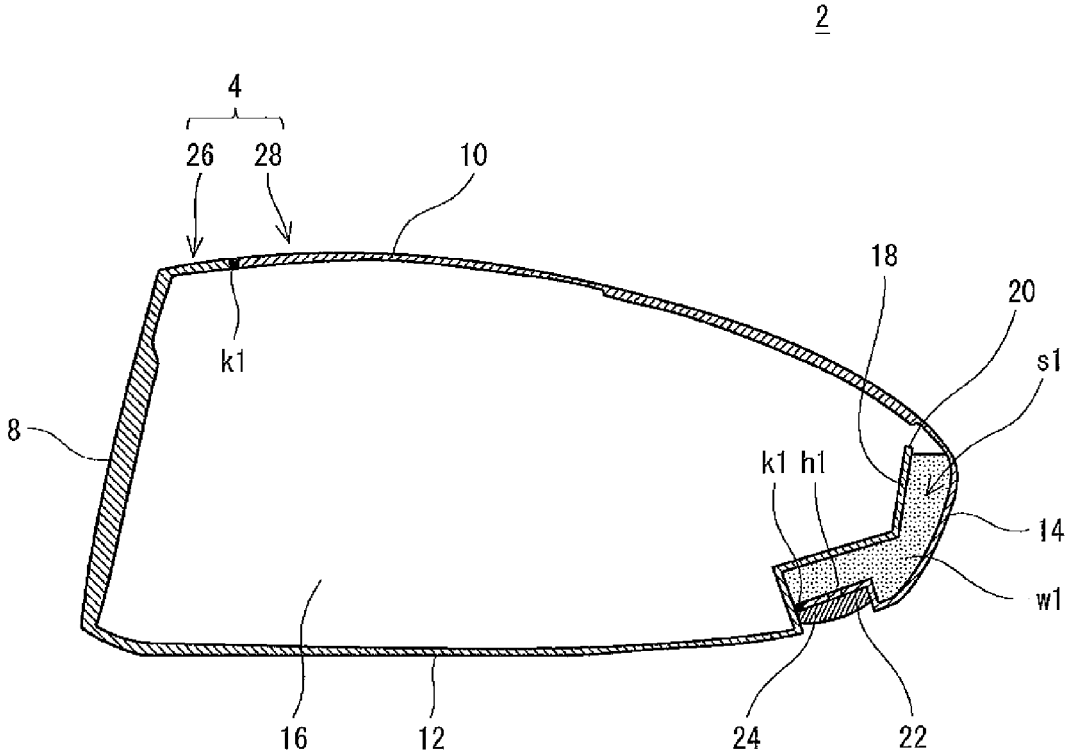
FIG. 5 is a sectional view taken along a V-V line in FIG. 3.

As shown in a sectional view of FIG. 5, the head 2 has an inside extended portion 18. The inside extended portion 18 is extended from the outer shell portion 4 to an inner part of the head 2. As shown in FIG. 5, the inside extended portion 18 has an end face 20. The end face 20 is a termination of the inside extended portion 18. The inside extended portion 18 is present in the hollow portion 16. The inside extended portion 18 is not visually recognized from an outside.

Figure 2:
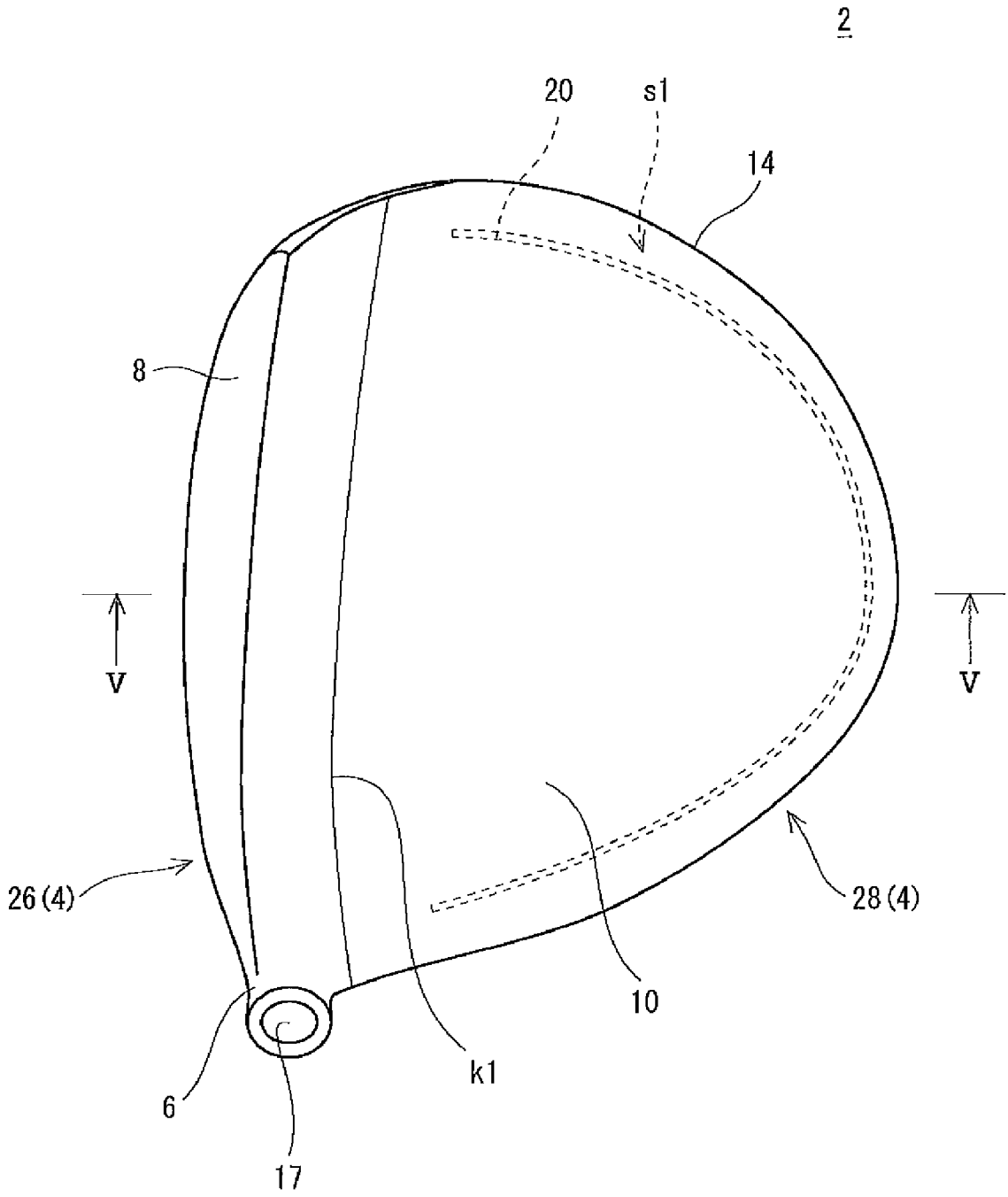
FIG. 2 is a plan view showing the head of FIG. 1 as seen from a crown side.
Figure 3:
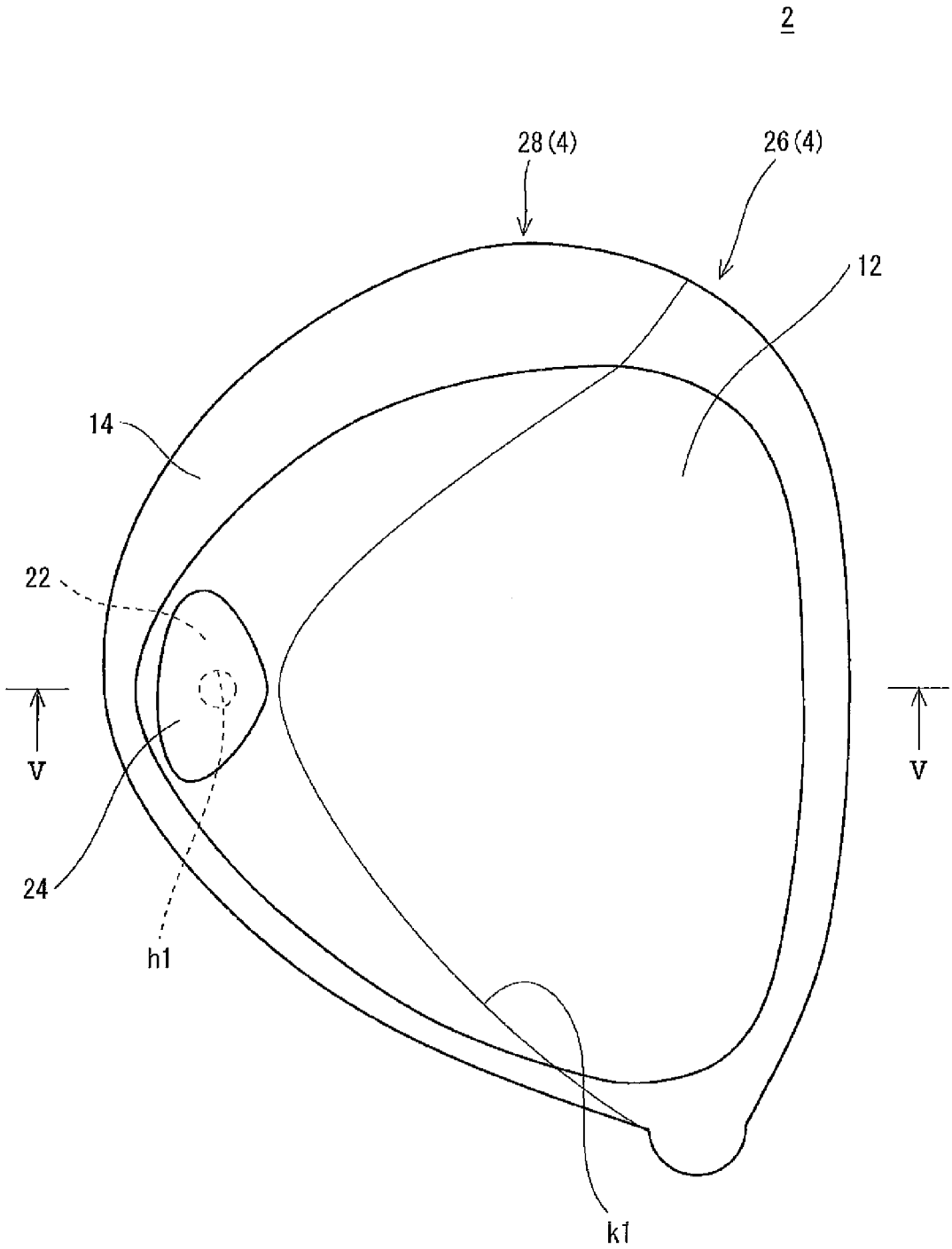
FIG. 3 is a bottom view showing the head of FIG. 1 as seen from a sole side.
Figure 4:
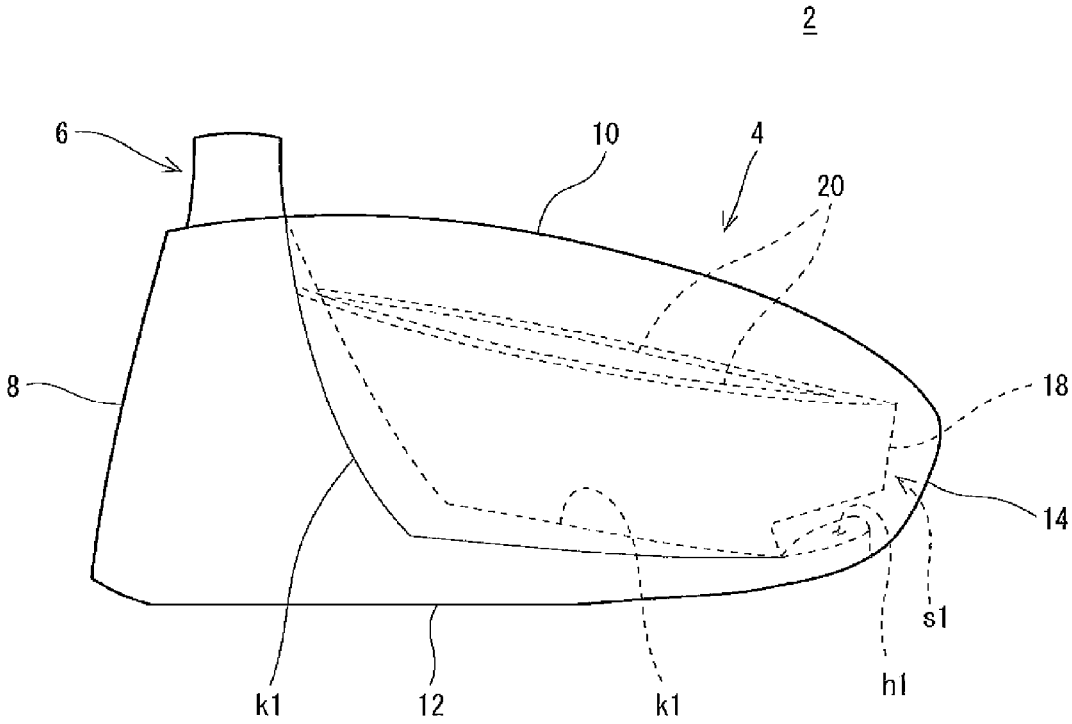
FIG. 4 is a side view showing the head of FIG. 1 as seen from a heel side.

In FIG. 2, only a contour line of the end face 20 in the inside extended portion 18 present in the hollow portion 16 is shown in a broken line. In FIG. 2, lines other than the end face 20 which are present in the head 2 are not shown. In FIG. 4, the contour line of the end face 20 in the inside extended portion 18 present in the hollow portion 16 is shown in a broken line. In FIG. 4, lines other than the contour line of the end face 20 and a part of the other contour lines which are present in the head 2 are properly omitted.

The head 2 has a housing portion s1. The housing portion s1 constitutes a part of the hollow portion 16. As shown in FIG. 5, the housing portion s1 forms a recess portion. The housing portion s1 is formed by the outer shell portion 4 and the inside extended portion 18. An external wall of the housing portion s1 is formed by the outer shell portion 4. An internal wall of the housing portion s1 is formed by the inside extended portion 18.

As shown in FIG. 5, the inside extended portion 18 is bent and extended almost along the outer shell portion 4. The inside extended portion 18 is extended from the sole portion 12 toward the crown portion 10. The end face 20 of the inside extended portion 18 is not provided in contact with the crown portion 10. The end face 20 is provided apart from the outer shell portion 4. The housing portion s1 is opened toward the crown side. When a state in which the head 2 is singly put stationarily over a horizontal plane with the sole portion 12 placed down is set to be a head stationary putting state, the housing portion s1 has a configuration capable of storing a liquid therein in the head stationary putting state. By the configuration, it is possible to stationarily put the head 2 on the horizontal plane until an adjusting material w1 which is heated and fluidized is injected into the head 2 and is then cooled. Accordingly, a work for injecting the adjusting material w1 can easily be carried out and the adjusting material w1 can be reliably disposed in the housing portion s1.

As shown in FIG. 2, the inside extended portion 18 is extended almost along the side portion 14. The inside extended portion 18 is extended almost along a periphery of the head 2.

The outer shell portion 4 has a through hole h1. The through hole h1 penetrates the outer shell portion 4. The through hole h1 causes the external surface of the head 2 to communicate with the housing portion s1. The through hole h1 is provided on an outer shell forming member 28.

The outer shell portion 4 is provided with a recess portion 22 formed on the external surface thereof (which will be hereinafter referred to as an external surface recess portion 22). The through hole h1 is provided on a bottom face of the external surface recess portion 22.

The through hole h1 is closed with a blocking member 24. The blocking member 24 is attached to the external surface of the outer shell portion 4. By the blocking member 24, the through hole h1 is hidden so that an appearance of the head 2 is enhanced. The blocking member 24 is disposed in the external surface recess portion 22. The blocking member 24 is accommodated in the external surface recess portion 22. A shape of the blocking member 24 corresponds to a shape of the external surface recess portion 22. For a material of the blocking member 24, a resin and a metal are preferable. The blocking member 24 is bonded to the outer shell portion 4 with an adhesive, for example. The blocking member 24 may be bonded to the outer shell portion 4 by a physical bonding method such as a screw mechanism. A character, a trademark, a mark and the like may be displayed on the blocking member 24. The blocking member 24 may be a so-called batch or the like.

The blocking member 24 can be attached and removed. In the case in which the blocking member 24 is bonded with the adhesive, it can be removed by peeling, heating or the like. In the case in which the blocking member 24 is bonded through the screw mechanism, it can be removed by loosening the screw mechanism.

Figure 6:
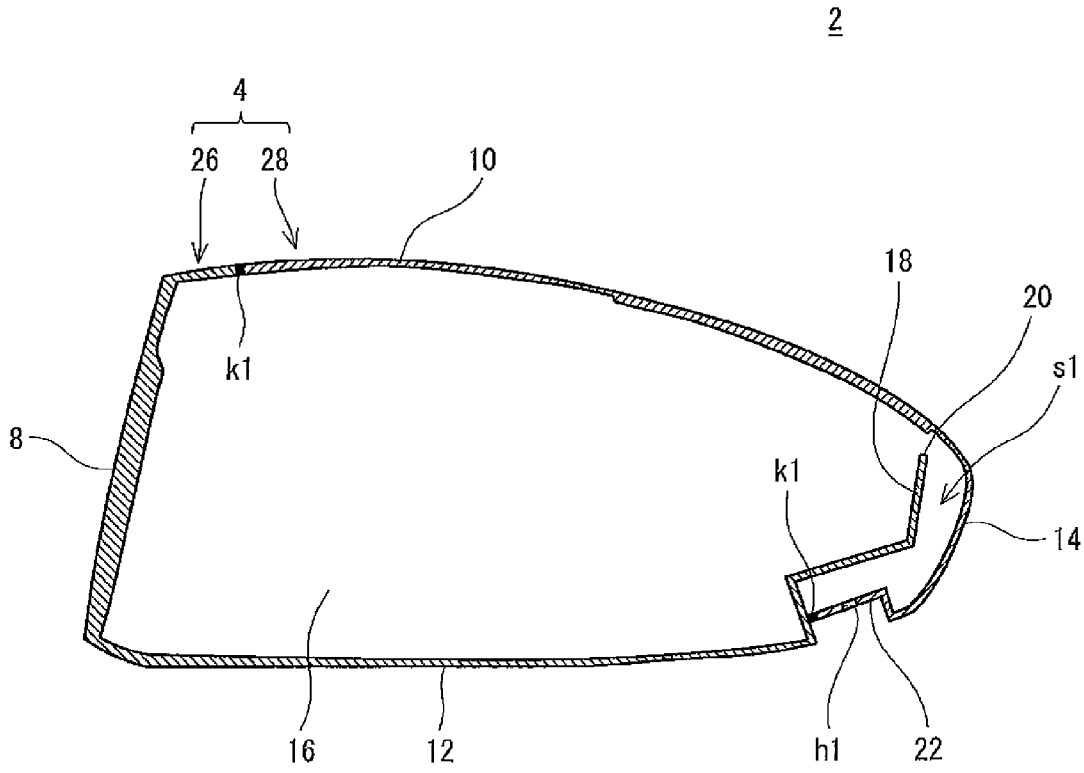
FIG. 6 is a sectional view showing a state in which an adjusting material and a blocking member are removed from FIG. 5.
Figure 7:
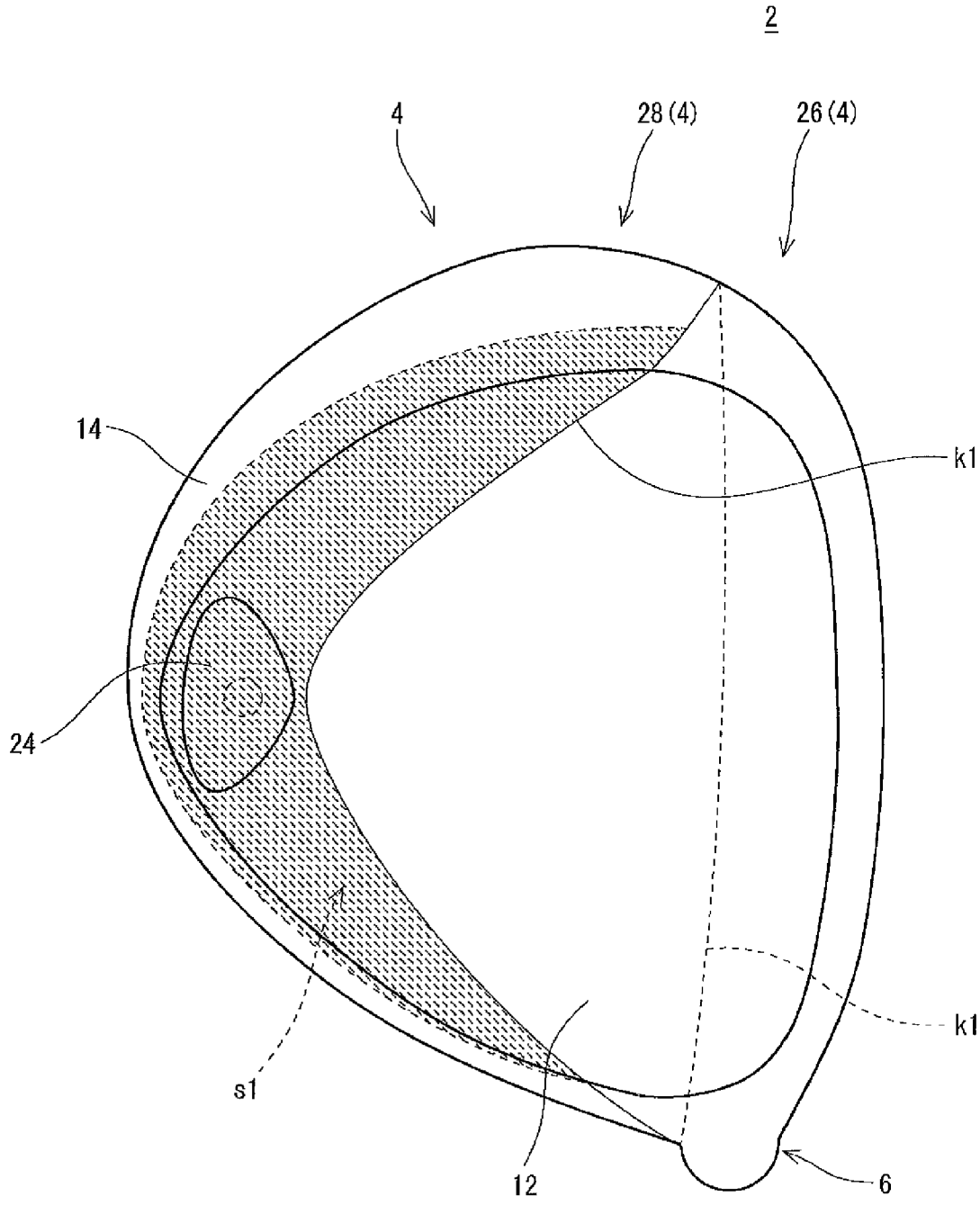
FIG. 7 is a view perspectively showing a range of a housing portion in broken line hatching in the bottom view showing the head of FIG. 1 as seen from the sole side.

As shown in FIG. 5, the adjusting material w1 is disposed in the housing portion s1. In FIG. 5, the adjusting material w1 is shown in a dot pattern (a dot). FIG. 6 is a sectional view for easy understanding in which the adjusting material w1 and the blocking member 24 are deleted from FIG. 5. Moreover, FIG. 7 is a view showing the head 2 seen from a sole side, perspectively illustrating a region of the housing portion s1 in broken line hatching.

The adjusting material w1 is caused to flow into the housing portion s1 in a fluidizing state. For this reason, the adjusting material w1 is provided in close contact with the internal surface of the housing portion s1. In at least an environment in which the head 2 is used, the adjusting material w1 is fixed to the housing portion s1. In at least the environment in which the head 2 is used, the adjusting material w1 is not fluidized.

In the head 2, a plurality of members formed integrally respectively is bonded. At least two of the members formed integrally are outer shell forming members. The outer shell forming member forms a part of the outer shell portion 4. The outer shell forming members are formed integrally respectively. The outer shell forming members formed integrally respectively are bonded to form the outer shell portion 4. The number of the outer shell forming members is not restricted but may be two as in the present embodiment or may be equal to or greater than three.

The outer shell portion 4 according to the present embodiment is formed by two outer shell forming members 26 and 28. The outer shell forming member 26 is positioned in a front part of the head 2. The outer shell forming member 28 is positioned in a rear part of the head 2.

The outer shell forming member 26 constitutes the whole face portion 8, a part of the crown portion 10, a part of the sole portion 12, a part of the side portion 14, and the hosel portion 6. The outer shell forming member 28 constitutes a part of the crown portion 10, a part of the sole portion 12, and a part of the side portion 14.

The outer shell forming member 26 is formed of 6-4 titanium (Ti-6Al-4V). The outer shell forming member 26 is formed by casting. The outer shell forming member 26 is formed by lost-wax precision casting.

The outer shell forming member 28 is formed of 6-4 titanium (Ti 6Al-4V). The outer shell forming member 28 is formed by casting. The outer shell forming member 28 is formed by the lost-wax precision casting.

In the present embodiment, the outer shell forming member 26 has the hosel portion 6. In the present embodiment, the head 2 is formed by only the outer shell forming member 26 and the outer shell forming member 28. The head 2 may be formed by bonding a member other than the outer shell forming member to a plurality of outer shell forming members.

In FIGS. 1, 2, 3 and 4, a boundary k1 between the outer shell forming member 26 and the outer shell forming member 28 is shown in a thin line. In FIG. 4, the boundary k1 which cannot be seen from a heel side (the boundary k1 positioned on a toe side of the head 2) is shown in a broken line. The boundary k1 indicates a bonding position of the outer shell forming member 26 and the outer shell forming member 28. In FIG. 5, the bonding position of the outer shell forming member 26 and the outer shell forming member 28, that is, the boundary k1 is painted out in a black color. In the boundary k1, the outer shell forming member 26 and the outer shell forming member 28 are bonded to each other. For a bonding method, welding is employed. The welding is set to be laser welding. The boundary k1 is visually recognized as a bonding line. The bonding line can be hidden by a surface treatment such as coating.

In the head 2 according to the present embodiment, thus, the outer shell forming member 26 has the inside extended portion 18 and the outer shell forming member 28 has the outer shell portion 4 to be a part of the housing portion s1. The inside extended portion 18 forms a part of the outer shell forming member 26. The inside extended portion 18 is formed integrally with the other portion of the outer shell forming member 26. In a process for manufacturing the head 2, a great deal of time and labor for manufacturing an inside extended portion unit is not required, and furthermore, a great deal of time and labor for bonding the inside extended portion unit to the other member is not required.

The through hole h1 communicates between an outside of the head 2 and the housing portion s1. By the presence of the through hole h1, it is possible to put the adjusting material w1 from the outside of the head 2 into the housing portion s1. By the presence of the through hole h1, furthermore, it is possible to discharge the adjusting material w1 from the housing portion s1 to the outside of the head 2.

In order to enable a regulation of a quantity of the adjusting material w1 after welding the outer shell forming member 26 and the outer shell forming member 28 together, it is preferable that the through hole h1 should be provided.

It is preferable that the adjusting material w1 should be an elastic body. The elastic body can absorb a vibration of the head 2. By setting the adjusting material w1 to be the elastic body, it is possible to regulate a hitting sound or a hitting feeling. When the quantity of the adjusting material w1 to be the elastic body is increased, the hitting sound tends to be lowered. By regulating the quantity or arrangement of the adjusting material w1, it is possible to regulate the hitting sound or the hitting feeling. The hitting sound is generated when a golf ball is hit. The hitting feeling is a sense taken by a golf player when hitting the golf ball.

In addition, the adjusting material w1 can fulfill a function of a weight adjusting material. By adjusting a weight of the adjusting material w1, it is possible to regulate a weight of the head or a position of a center of gravity of the head. By positioning the adjusting material w1, it is possible to adjust the position of the center of gravity of the head.

In order to enhance the adjusting function of the adjusting material w1, the adjusting material w1 can be preferably injected into and discharged from the through hole h1. From this viewpoint, it is preferable that the adjusting material w1 should have a fluidity through heating and should be solidified at an ordinary temperature. In this respect, a thermoplastic resin is preferable for the adjusting material w1. In order to prevent the adjusting material w1 from being moved in use of a golf club, a melting point of the adjusting material w1 is preferably equal to or higher than 70° C. and is more preferably equal to or higher than 80° C. If a heating temperature is controlled when the adjusting material w1 is to be discharged, the adjusting material w1 can easily be discharged and a damage on the head due to the heating can be suppressed. From this viewpoint, the melting point of the adjusting material w1 is preferably equal to or lower than 200° C. and is more preferably equal to or lower than 150° C.

A suitable material for the adjusting material w1 includes polyisobutene, polyisobutylene, ethers such as polyvinyl ether, acryl based tackifiers and the like, for example. More specifically, examples include a trade name "TETRAX" (polyisobutylene) or "EVERTACK" (polybutene) which is manufactured by Nippon Petrochemicals Co., Ltd., and the like.

In addition to the materials described above, the suitable thermoplastic resin for the material of the adjusting material w1 includes a polyamide resin, a polyester resin, a polycarbonate resin, a polystyrene resin, a polyethylene resin, a polyvinyl acetate based resin, an AS resin (an acrylonitrile styrene resin), a methacrylic resin, a polypropylene resin, a fluorine resin, an ionomer based resin, and an urethane resin. In respect of an easiness of the weight adjustment, it is more preferable to use the polystyrene based resin and the methacrylic resin which have low melting and softening points.

In addition to the foregoing, as the material of the adjusting material w1, it is possible to use a low-melting metal, for example. The low-melting metal is not particularly restricted. In respect of a form stability, a melting point of the low-melting metal is preferably equal to or higher than 150° C. and is more preferably equal to or higher than 170° C. In respect of a productivity and a handling property, the melting point of the low-melting metal is preferably equal to or lower than 250° C. and is more preferably equal to or lower than 230° C. Since a low-melting metal material has a comparatively great specific gravity, it is also effective for a design of a center of gravity of the head. From this viewpoint, the specific gravity of the low-melting metal is preferably equal to or greater than 6.0 and is more preferably equal to or greater than 7.0. In respect of an availability of the material, the specific gravity of the low-melting metal is preferably equal to or smaller than 9.0. In order to enhance a degree of freedom in the design of the center of gravity of the head, it is preferable that the specific gravity of the low-melting metal should be greater than a specific gravity (a mean specific gravity) of the head. For a specific low-melting metal, it is possible to use Sn-3.0Ag-0.5Cu (a specific gravity of 7.4 and a melting point of 217 to 220° C.), Sn-58Bi (a specific gravity of 8.6 and a melting point of 139° C.) or an Sn—Zn based alloy (a specific gravity of 7.3 and a melting point of 199 to 222° C.) which has been known as a solder.

In the case in which the quantity of the adjusting material w1 is to be decreased, the blocking member 24 is first removed and the head 2 is then heated from the outside. By the heating, a temperature of the adjusting material w1 is raised. When the adjusting material w1 is fluidized, the adjusting material w1 is discharged from the through hole h1. Thereafter, the blocking member 24 is attached again. For example, the golf player can adjust the quantity of the adjusting material w1 to obtain a favorite hitting sound or feeling.

Figure 8:
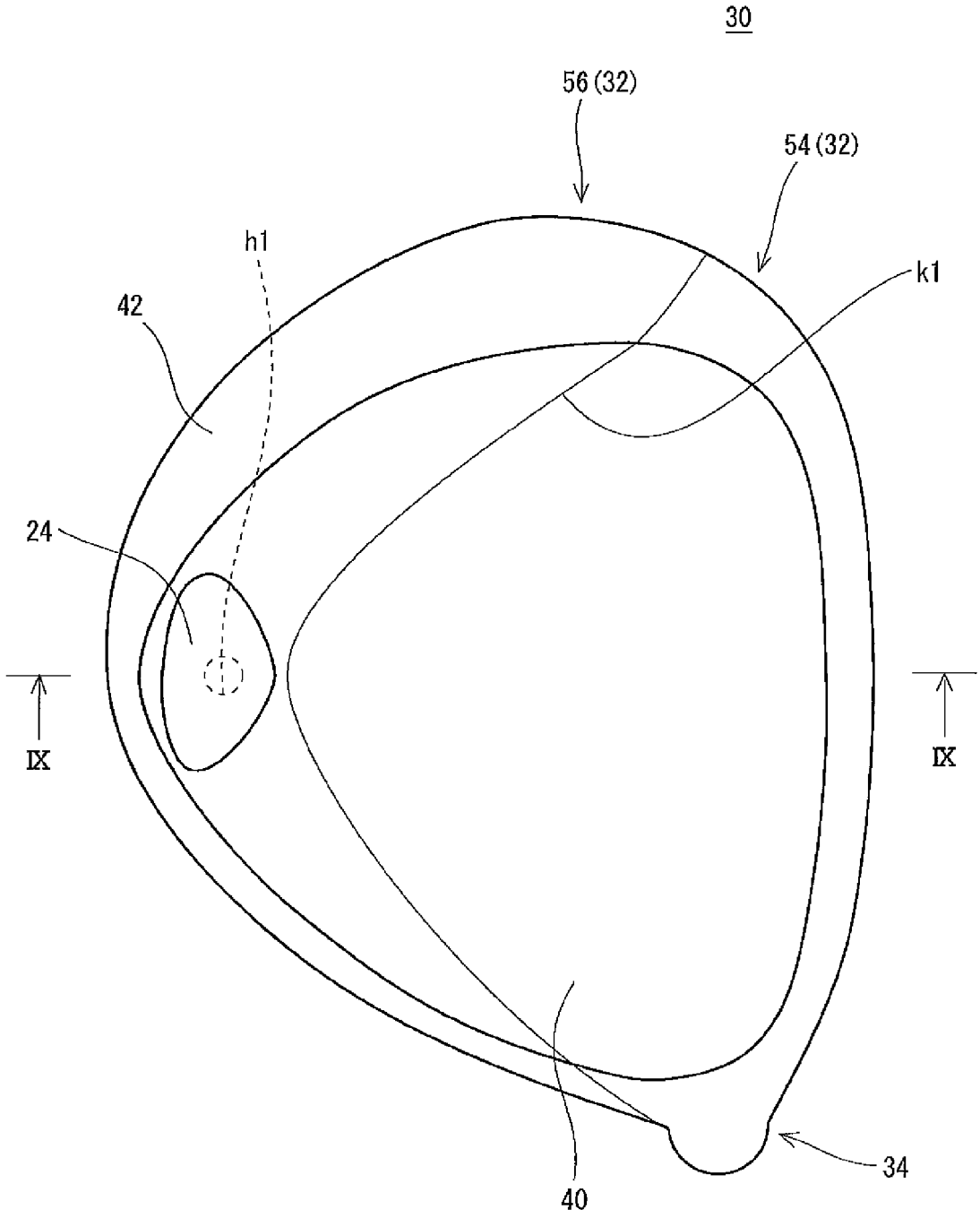
FIG. 8 is a bottom view showing a golf club head according to a second embodiment as seen from a sole side.
Figure 9:
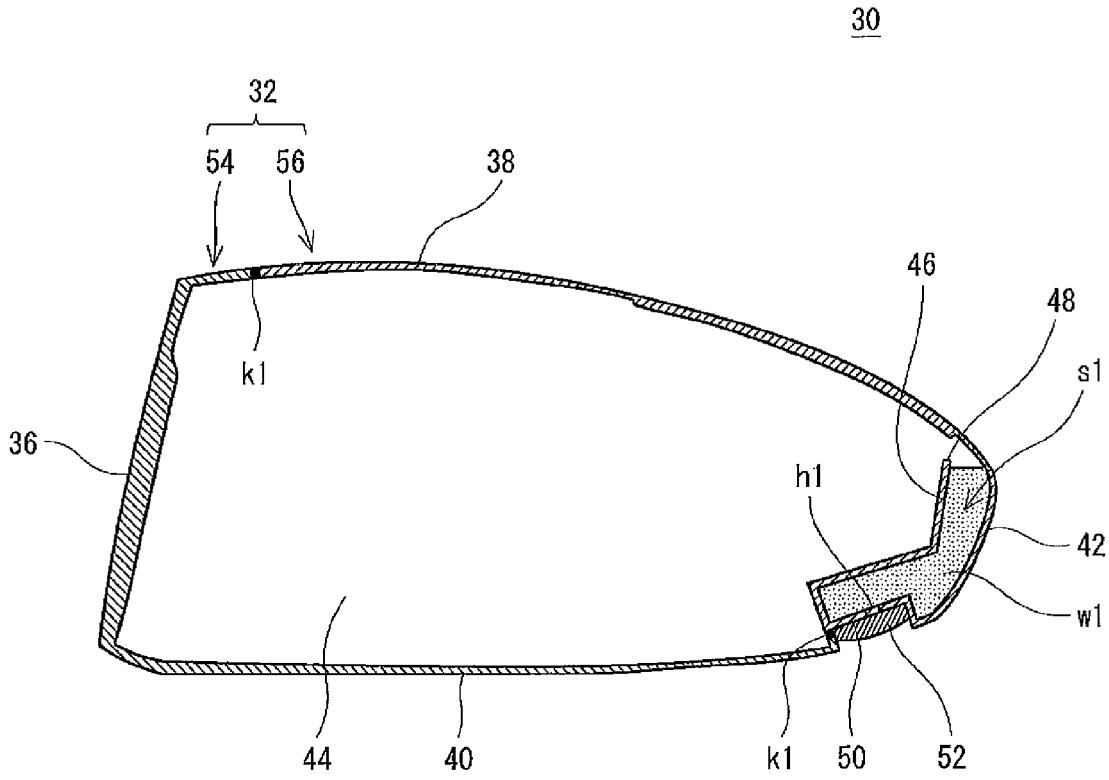
FIG. 9 is a sectional view taken along an IX-IX line in FIG. 8.

FIGS. 8 and 9 show a head 30 according to another embodiment. FIG. 8 is a view showing the head 30 seen from a sole side and FIG. 9 is a sectional view taken along an IX-IX line in FIG. 8.

A shape of the head 30 is the same as the shape of the head 2 described above. A shape of a housing portion s1 is identical in the head 2 and the head 30. The heads 2 and 30 are different from each other in that which one of two outer shell forming members has an inside extended portion.

The head 30 has an outer shell portion 32 and a hosel portion 34. The outer shell portion 32 constitutes an external surface of the head 30. An external surface of the outer shell portion 32 serves as the external surface of the head 30. The outer shell portion 32 has a face portion 36, a crown portion 38, a sole portion 40 and a side portion 42. A hollow portion 44 is present in the outer shell portion 32. More specifically, the hollow portion 44 is formed by the outer shell portion 32.

As shown in a sectional view of FIG. 9, the head 30 has an inside extended portion 46. The inside extended portion 46 is extended from the outer shell portion 32 to an inner part of the head 30. As shown in FIG. 9, the inside extended portion 46 has an end face 48. The end face 48 is a termination of the inside extended portion 46.

The head 30 has the housing portion s1. The housing portion s1 constitutes apart of the hollow portion 44. As shown in FIG. 9, the housing portion s1 forms a recess portion. The housing portion s1 is formed by the outer shell portion 32 and the inside extended portion 46. An external wall of the housing portion s1 is formed by the outer shell portion 32. An internal wall of the housing portion s1 is formed by the inside extended portion 46.

As shown in FIG. 9, the inside extended portion 46 is bent and extended almost along the outer shell portion 32. The inside extended portion 46 is extended from the sole portion 40 toward the crown portion 38. The end face 48 of the inside extended portion 46 is not provided in contact with the crown portion 38. The end face 48 is provided apart from the outer shell portion 32.

The outer shell portion 32 has a through hole h1. The through hole h1 penetrates the outer shell portion 32. The through hole h1 causes an external surface of the head 30 to communicate with the housing portion s1.

The outer shell portion 32 is provided with a recess portion 50 formed on the external surface thereof (which will be hereinafter referred to as an external surface recess portion 50). The through hole h1 is provided on a bottom face of the external surface recess portion 50.

The through hole h1 is closed with a blocking member 52. The blocking member 52 is attached to the external surface of the outer shell portion 32. By the blocking member 52, the through hole h1 is hidden so that an appearance of the head 30 is enhanced. The blocking member 52 is disposed in the external surface recess portion 50. The blocking member 52 is accommodated in the external surface-recess portion 50. A shape of the blocking member 52 corresponds to a shape of the external surface recess portion 50.

As shown in FIG. 9, an adjusting material w1 is disposed in the housing portion s1. In FIG. 9, the adjusting material w1 is shown in a dot pattern (a dot).

In the head 30, a plurality of members formed integrally respectively is bonded. The outer shell portion 32 according to the present embodiment is formed by two outer shell forming members 54 and 56. The outer shell forming member 54 is positioned in a front part of the head 30. The outer shell forming member 56 is positioned in a rear part of the head 30.

The outer shell forming member 54 includes the whole face portion 36, a part of the crown portion 38, a part of the sole portion 40, a part of the side portion 42, and the hosel portion 34. The outer shell forming member 56 includes a part of the crown portion 38, a part of the sole portion 40, and a part of the side portion 42.

The outer shell forming member 54 is formed of 6-4 titanium (Ti-6Al-4V). The outer shell forming member 54 is formed by casting. The outer shell forming member 54 is formed by lost-wax precision casting.

The outer shell forming member 56 is formed of 6-4 titanium (Ti-6Al-4V). The outer shell forming member 56 is formed by casting. The outer shell forming member 56 is formed by the lost-wax precision casting.

In FIG. 8, a boundary k1 between the outer shell forming member 54 and the outer shell forming member 56 is shown in a thin line. The boundary k1 indicates a bonding position of the outer shell forming member 54 and the outer shell forming member 56. In FIG. 9, the bonding position of the outer shell forming member 54 and the outer shell forming member 56, that is, the boundary k1 is painted out in a black color. In the boundary k1, the outer shell forming member 54 and the outer shell forming member 56 are bonded to each other. For a bonding method, welding is employed. The welding is set to be laser welding. The boundary k1 is visually recognized as a bonding line. The bonding line can be hidden by a surface treatment such as coating.

In the head 2 according to the first embodiment, the outer shell forming member 26 having the face portion and the like has the inside extended portion 18. On the other hand, in the head 30 according to the present embodiment, the outer shell forming member 54 having the face portion and the like does not have the inside extended portion 46 but the outer shell forming member 56 has the inside extended portion 46. In the head 30, the outer shell forming member 56 has the housing portion s1. The outer shell forming member 56 has the whole housing portion s1.

In the head 2 according to the first embodiment, the outer shell forming member 26 constitutes a part of the housing portion s1 and the outer shell forming member 28 constitutes another part of the housing portion s1. In the head 2, the housing portion s1 is not formed until the outer shell forming member 26 and the outer shell forming member 28 are bonded to each other. On the other hand, in the head 30 according to the present embodiment, the outer shell forming member 56 singly has the housing portion s1. The outer shell forming member 54 does not have a part of the housing portion s1. The outer shell forming member 54 does not form the housing portion s1.

Thus, the head 2 and the head 30 have different members to which the inside extended portion belongs. For this reason, the bonding (welding) positions in the vicinity of the sole portions are slightly different from each other in the head 2 and the head 30. More specifically, as shown in FIG. 5, the end face of an edge part on the sole side of the outer shell forming member 28 and a surface of the outer shell forming member 26 are bonded (welded) to each other in the head 2. On the other hand, in the head 30, the end face of an edge part on the sole side of the outer shell forming member 54 and a surface of the outer shell forming member 56 are bonded (welded) to each other. As shown in FIGS. 5 and 9, the head 2 and the head 30 have an identical bonding configuration in the crown portion.

The outer shell forming member 56 is formed by casting a metallic material. The outer shell forming member 56 is formed integrally through the casting. It is possible to take a complicated shape or a shape having an undercut through the casting. In the present embodiment, the housing portion s1 is formed integrally as a part of the outer shell forming member 56. By a casting process, it is also possible to form the housing portion s1 having the complicated shape with a high productivity. On the other hand, in the head 2 according to the first embodiment, the housing portion s1 is formed by bonding the outer shell forming members to each other. As compared with the case in which the single outer shell forming member has the housing portion s1 (the outer shell forming member 56), therefore, it is possible to simplify the shape of the outer shell forming member. By the simplification of the shape, it is possible to reduce a defective ratio in the formation of the outer shell forming member. By the simplification of the shape, moreover, it is possible to enhance a productivity of the outer shell forming member. By the simplification of the shape, furthermore, it is possible to relax the restriction of a method of manufacturing the outer shell forming member. By the relaxation of the restriction of the manufacturing method, it is possible to relieve a restriction of a material which can be used.

In the same manner as in the head 2 described above, also in the head 30, a great deal of time and labor for manufacturing the inside extended portion unit is not required, and furthermore, a great deal of time and labor for bonding the inside extended portion unit to the other member is not required.

The through hole h1 communicates between the outside of the head 30 and the housing portion s1. The through hole h1 is provided on the outer shell forming member 56. By the presence of the through hole h1, it is possible to put the adjusting material w1 from the outside of the head 30 into the housing portion s1. By the presence of the through hole h1, furthermore, it is possible to discharge the adjusting material w1 from the housing portion s1 to the outside of the head 30.

In the head 30, the outer shell forming member 56 has the housing portion s1. Therefore, it is also possible to put the adjusting material w1 in the housing portion s1 in a stage before the outer shell forming member 56 and the outer shell forming member 54 are welded to each other. In this case, it is possible to dispose the adjusting material w1 without providing the through hole h1. As described above, it is preferable that the through hole h1 should be provided in order to enable the regulation of the weight of the adjusting material w1 or the like.

A size (volume), an arrangement and the like of the housing portion s1 are not restricted to the structures according to the embodiments but may be properly set. In order to enhance a hitting feeling, a hitting sound, a position of a center of gravity of the head and the like, it is possible to set the size (volume) or arrangement of the housing portion s1. When the quantity of the adjusting material w1 is increased, the hitting sound tends to be lowered. When the quantity of the adjusting material w1 is decreased, the hitting sound tends to be raised. Although the housing portion s1 is provided across the sole portion and the side portion in the embodiments described above, the housing portion s1 may be disposed in the crown portion, for example.

A material of the outer shell forming member is not restricted. Examples of the material of the outer shell forming member include a metal, a fiber reinforced plastic (FRP) and a resin (no fiber reinforcement). In order to cause a strength of the head to be consistent with a lightweight property, it is preferable to use the metal or the metal and the FRP together for the material of the outer shell forming member. In respect of the strength of the head and the lightweight property, a CFRP (carbon fiber reinforced plastic) is preferable for the FRP.

The metal to be the material of the outer shell forming member is not restricted but it is possible to employ a titanium alloy, pure titanium, stainless steel, an aluminum alloy, a magnesium alloy, a zirconium based metallic glass, maraging steel, carbon steel, an Fe—Al—Mg alloy and the like. Examples of the titanium alloy include Ti-6Al-4V (a specific gravity of 4.42), Ti-10V-2Fe-3Al (a specific gravity of 4.65), Ti-15Al-3Cr-3Sn-3Al (a specific gravity of 4.76), Ti -4.5Al-3V-2Fe-2Mo (a specific gravity of 4.60), Ti-5.5Al-1Fe (a specific gravity of 4.38), Ti-15Mo-5Zr-3Al (a specific gravity of 4.95), Ti-22V-4Al (a specific gravity of 4.69), Ti-15V.6Cr-4Al (a specific gravity of 4.72 to 4.74), and the like.

The method of bonding the outer shell forming members is not restricted but it is possible to employ welding, an adhesion with an adhesive or a fixation through a plastic deformation and their combination. In the case in which the outer shell forming member is formed of only a metal, it is preferable that the outer shell forming members should be welded to each other in respect of an enhancement in a strength. For the welding, it is possible to suitably use laser welding, plasma welding and TIG welding.

For the method of manufacturing the outer shell forming member, it is possible to employ casting, forging, press or the like. In case of a complicated shape, the casting is preferable. In particular, the outer shell forming member including the housing portion s1 takes a complicated shape as in the outer shell forming member 56. Therefore, the casting is preferable. In respect of precision in a formation, in case of the casting, lost-wax precision casting is more preferable.

In the present invention, thus, it is possible to form a housing portion in a hollow head while achieving a high productivity and a low cost.

The present invention can be applied to all of golf club heads, for example, a golf club head of a wood type, a golf club head of an iron type and the like.

The above description is only illustrative and various changes can be made without departing from the scope of the present invention.

What is claimed is:

1. A golf club head comprising an outer shell portion forming an external surface of the head and a hollow portion of the head, an inside extended portion extended from the outer shell portion to an inner part of the head and having an end face provided apart from the outer shell portion, a housing portion formed by the outer shell portion and the inside extended portion, and an adjusting material disposed in the housing portion, wherein the outer shell portion is formed by bonding a plurality of outer shell forming members formed integrally respectively, one of the outer shell forming members includes the inside extended portion, and the other outer shell forming member includes the outer shell portion that forms a part of the housing portion.

2. The golf club head according to claim 1, wherein a through hole for causing the external surface of the head to communicate with the housing portion is provided.

3. The golf club head according to claim 2, wherein the adjusting material is a thermoplastic resin.

4. The golf club head according to claim 1, wherein the adjusting material is a thermoplastic resin.

5. A golf club head comprising an outer shell portion forming an external surface of the head and a hollow portion of the head, an inside extended portion extended from the outer shell portion to an inner part of the head and having an end face provided apart from the outer shell portion, a housing portion formed by the outer shell portion and the inside extended portion, and an adjusting material disposed in the housing portion, wherein the outer shell portion is formed by bonding a plurality of outer shell forming members formed integrally respectively, one of the outer shell forming members integrally includes the entire housing portion and is formed by casting a metallic material, an external wall of the housing portion is formed by the outer shell portion, and an internal wall of the housing portion is formed by the inside extended portion.

6. The golf club head according to claim 5, wherein a through hole for causing the external surface of the head to communicate with the housing portion is provided.

7. The golf club head according to claim 6, wherein the adjusting material is a thermoplastic resin.

8. The golf club head according to claim 5, wherein the adjusting material is a thermoplastic resin.

9. A golf club head comprising an outer shell portion forming an external surface of the head and a hollow portion of the head, an inside extended portion extended from the outer shell portion to an inner part of the head and having an end face provided apart from the outer shell portion, a housing portion formed by the outer shell portion and the inside extended portion, and an adjusting material disposed in the housing portion, wherein the outer shell portion is formed by bonding a plurality of outer shell forming members formed integrally respectively, the outer shell portion has a face portion, a crown portion, a sole portion and a side portion, a first of the outer shell forming members includes the housing portion and is formed by casting a metallic material, an end face of an edge part on the sole side of a second of the outer shell forming members is bonded to a surface of the first outer shell forming member.

10. A golf club head comprising an outer shell portion forming an external surface of the head and a hollow portion of the head, an inside extended portion extended from the outer shell portion to an inner part of the head and having an end face provided apart from the outer shell portion, a housing portion formed by the outer shell portion and the inside extended portion, and an adjusting material disposed in the housing portion, wherein the outer shell portion is formed by bonding a plurality of outer shell forming members formed integrally respectively, the outer shell portion has a face portion, a crown portion, a sole portion and a side portion, a first of the outer shell forming members includes the housing portion and is formed by casting a metallic material, and the first outer shell forming member includes a part of the crown portion, a part of the sole portion and a part of the side portion of the outer shell portion.

* * * * *